US006657387B1

(12) United States Patent
Yoo

(10) Patent No.: US 6,657,387 B1
(45) Date of Patent: Dec. 2, 2003

(54) PLASMA DISPLAY PANEL (PDP) HAVING BLACK MATRIX MADE OF LIGHT SHIELDING MATERIAL FILLED IN A GROOVE FORMED IN THE FRONT SUBSTRATE OF PDP BETWEEN ADJACENT DISCHARGE CELLS

(75) Inventor: Minsun Yoo, Chunan (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 0 days.

(21) Appl. No.: 09/559,521

(22) Filed: Apr. 28, 2000

(30) Foreign Application Priority Data

Apr. 30, 1999 (KR) ..... 1999-15634

(51) Int. Cl.[7] ..... H01J 29/10
(52) U.S. Cl. ..... 313/587; 313/582
(58) Field of Search ..... 313/582, 583, 313/584, 585, 586, 587, 491

(56) References Cited

FOREIGN PATENT DOCUMENTS

KR 2001037481 A * 5/2001

* cited by examiner

*Primary Examiner*—Nimeshkumar D. Patel
*Assistant Examiner*—Joseph Williams
(74) *Attorney, Agent, or Firm*—Lowe Hauptman Gilman & Berner LLP

(57) ABSTRACT

A plasma display includes a rear substrate, a plurality of first electrodes formed in strips and parallel to each other on an inner surface of the rear substrate, a dielectric layer coated on the rear substrate to cover the first electrode, a plurality of partitions formed in strips on the dielectric layer, defining a discharge space, a fluorescent layer coated on an inner surface of the discharge space, a front substrate which is transparent and coupled above the partitions, second and third electrodes formed in strips and to be parallel to one another on an inner surface of the front substrate and to cross the first electrode, and a black matrix formed between a discharge cell constituted by a pair of the second and third electrodes and another discharge cell adjacent thereto, by filling a groove which is formed at the inner surface of the front substrate to be parallel to the second and third electrodes with a light shielding material.

7 Claims, 5 Drawing Sheets

PLASMA DISPLAY PANEL (PDP) HAVING BLACK MATRIX MADE OF LIGHT SHIELDING MATERIAL FILLED IN A GROOVE FORMED IN THE FRONT SUBSTRATE OF PDP BETWEEN ADJACENT DISCHARGE CELLS

BACKGROUND OF THE INVENTION

1. Field of the Invention

The present invention relates to a plasma display which can reduce reflection of external light and a method of forming a black matrix in the plasma display.

2. Description of the Related Art

A typical plasma display forms an image by exciting fluorescent material using ultraviolet rays generated when gas disposed between a pair of substrates is discharged. The plasma display is divided into an AC type, a DC type, and a hybrid type.

FIG. 1 shows an example of a conventional AC type plasma display. Referring to the drawing, a plasma display includes a rear substrate 10, a first electrode 11 being an address electrode formed in strips on the rear substrate 10, a is dielectric layer 12 formed on the rear substrate 10 to cover the first electrode 11, a plurality of partitions 13 formed in strips on the upper surface of the dielectric layer 12 and defining a discharge space to prevent optical cross talk between discharge cells, and a fluorescent layer 15 coated on the inner surface of the discharge space.

A front substrate 18 is coupled above the partitions 13. A second electrode 16 and a third electrode 17 are formed on the lower surface of the front substrate 18 to cross the first electrode 11. The second and third electrodes 16 and 17 are formed of indium tin oxide (ITO) which is transparent. Here, a bus electrode 16*a* and 17*a* can be provided to reduce line resistance. The bus electrode 16*a* and 17*a* is limited in its width as narrow as possible to minimize blocking light which is generated by exciting the fluorescent material in the discharge space and passes through the front substrate 18. For example, the bus electrode 16*a* and 17*a* can be formed in a print method using metal such as silver (Ag) paste or a photolithography using a photosensitive film.

A dielectric layer 19 is formed on the lower surface of the front substrate 18 covering the second and third electrodes 16 and 17. A protective layer 21 can be coated on the lower surface of the dielectric layer 19. Also, a black matrix 22 is formed between the respective discharge cells.

In the operation of the plasma display having the above structure, the black matrix 22 does not reflect but absorbs part of external light (indicated by a dotted line in FIG. 2) input to the front substrate 18 so that contrast is improved.

As the width of the black matrix 22 increases, the reflectance of external light is lowered so that contrast is improved. However, the effect of the reduction of reflectance of external light due to an increase in the width of the black matrix 22 is not noticeable. Furthermore, when the width of the black matrix 22 is too great, light image emitted from the discharge space to the outside is blocked, thus lowering brightness.

Also, by blacking the color of the bus electrode 16*a* and 17*a*, provided to the second and third electrodes 16 and 17, the same effect as that of the black matrix 22 can be obtained. However, since the width of the bus electrode 16*a* and 17*a* is extremely narrow, there is a limit to lower the reflectance of external light.

SUMMARY OF THE INVENTION

To solve the above problems, it is an objective of the present invention to provide a plasma display adopting a black matrix in a groove formed in a front glass substrate to reduce reflection of external light so that contrast of an image can be improved, and a method of forming a black matrix in the plasma display.

Accordingly, to achieve the above objective, there is provided a plasma display comprising a rear substrate, a plurality of first electrodes formed in strips and parallel to each other on an inner surface of the rear substrate, a dielectric layer coated on the rear substrate to cover the first electrode, a plurality of partitions formed in strips on the dielectric layer, defining a discharge space, a fluorescent layer coated on an inner surface of the discharge space, a front substrate which is transparent and coupled above the partitions, second and third electrodes formed in strips and to be parallel to one another on an inner surface of the front substrate and to cross the first electrode, and a black matrix formed between a discharge cell constituted by a pair of the second and third electrodes and another discharge cell adjacent thereto, by filling a groove which is formed at the inner surface of the front substrate to be parallel to the second and third electrodes with a light shielding material.

It is preferred in the present invention that the black matrix is formed in a groove which is formed in the front substrate.

Also, it is preferred in the present invention that the profile of the black matrix has a dam shape.

Also, it is preferred in the present invention that the profile of the black matrix has a curved V-shape.

Also, it is preferred in the present invention that the height H of the black matrix, the incident angle $\theta$ of external light and the distance D between adjacent black matrices have the relationship, $H \tan \theta \geqq (D/2)$.

Also, it is preferred in the present invention that the height H of the black matrix is 30 through 60 micrometers.

Also, it is preferred in the present invention that the height H of the black matrix is 50 micrometers.

According to another aspect of the present invention, there is provided a method of forming a black matrix of a plasma display which comprises the steps of forming a groove of a predetermined pattern at an inner surface of a front glass substrate of the plasma display, filling the groove of a predetermined pattern with a light shield material, and fusing the black matric material to adhere to the glass substrate by burning the front glass substrate.

It is preferred in the present invention that the method further comprises a step of forming a protection film for preventing black matrix from spreading on an inner surface of the front glass substrate, after the step of burning.

Also, it is preferred in the present invention that the groove of a predetermined pattern on the inner surface of the front glass substrate is formed by pressing the front glass substrate by a mold.

Also, it is preferred in the present invention that the groove of a predetermined pattern on the inner surface of the front glass substrate is formed by etching the front glass substrate in a state in which a predetermined photoresist pattern is formed on the front glass substrate.

Also, it is preferred in the present invention that light shielding material is black inorganic pigment or material for a neutral density (ND) filter.

According to yet another aspect of the present invention, there is provided a method of forming a black matrix of a plasma display which comprises the steps of coating transparent paste which is a mixture of glass powder and adhesive and opaque paste which is a mixture of glass powder, adhesive and light shielding material on a film support body in a predetermined pattern, forming a green tape by pressing transparent paste on the film support body and the opaque paste, attaching the green tape on a front glass substrate of the plasma display to the green tape and removing the film support body, and performing a burning process so that the transparent paste and the opaque paste can be fused and adhered to the front glass substrate.

It is preferred in the present invention that the method further comprises a step of forming a protection film on an inner surface of the transparent paste and the opaque paste after the burning process.

According to further another aspect of the present invention, there is provided a method of forming a black matrix of a plasma display which comprises the steps of forming a green tape by coating a transparent paste which is formed by mixing glass powder and paste on a film support body, laminating the green tape on an inner surface of a front glass substrate of the plasma display, forming a groove of a predetermined pattern on the green tape, filling the groove with light shielding material, and fusing the black matrix material to adhere to the glass substrate by burning the front glass substrate.

It is preferred in the present invention that the step of forming a groove a predetermined pattern at the green tape is made by pressing the surface of the green tape using a mold.

Also, it is preferred in the present invention that the groove of a predetermined pattern on the green tape is formed by etching the surface of the green tape in a state in which a predetermined photoresist pattern is formed.

Also, it is preferred in the present invention that the method further comprises a protection film on the surface of the green tape.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 3:
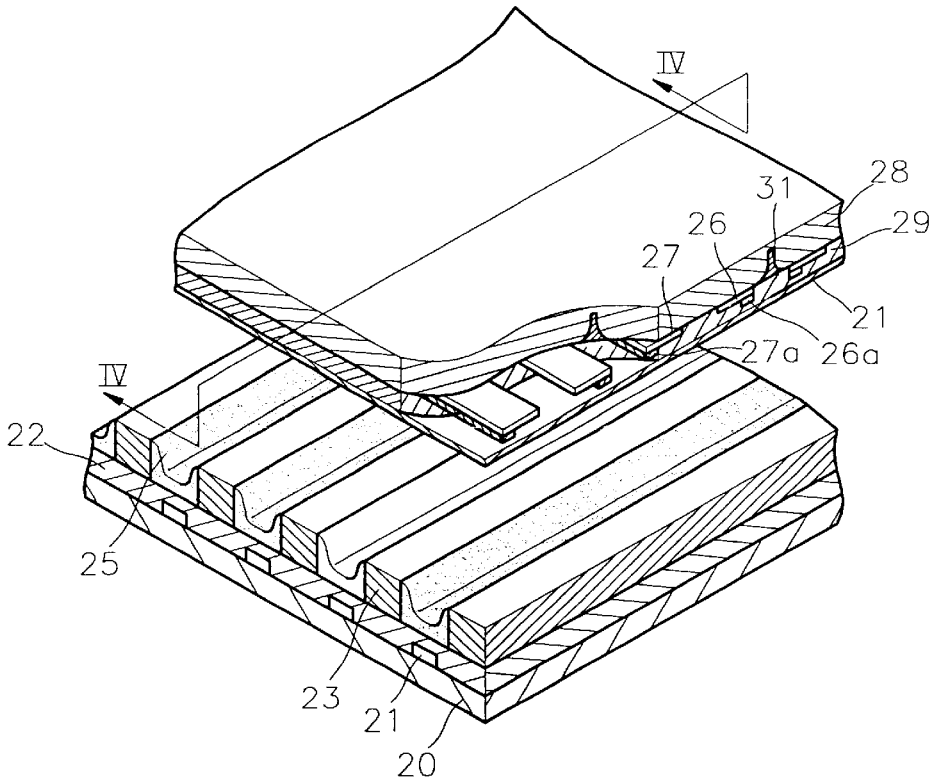
FIG. 3 is an exploded perspective view of a plasma display according to a preferred embodiment of the present invention.

FIG. 3 shows a plasma display according to a preferred embodiment of the present invention. Referring to the drawing, a first electrode 21 is formed in strips on the inner surface of the rear substrate 20, which is an address electrode. The first electrode 21 is covered by a dielectric layer 22 formed on the inner surface of the rear substrate 20. A partition 23 is formed on the upper surface of the dielectric layer 22 in strips and parallel to the first electrode 21, defining a discharge space. A fluorescent layer 25 is coated on the inner surface of the discharge space.

A transparent front substrate 28 is coupled above the partition 23. A second electrode 26 and a third electrode 27 are formed on the inner surface of the front substrate 28 in strips to cross the first electrode 21. Bus electrodes 26 and 27 are provided to the second and third electrodes 26 and 27 to reduce line resistance. Also, a dielectric layer 29 is formed on the lower surface of the front substrate 28 to cover the second and third electrodes 26 and 27. A protective layer 21 can be coated on the lower surface of the dielectric layer 29.

Figure 4:
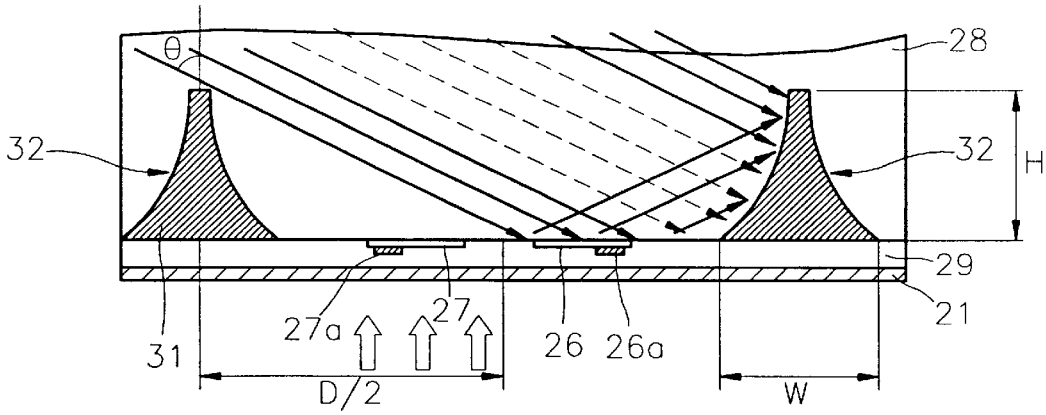
FIG. 4 is a sectional view of the plasma display, taken along line IV—IV of FIG. 3.

According to the present invention, a discharge cell including the second and third electrodes 26 and 27 is formed and a groove is formed at the inner surface of the front substrate between the other neighboring discharge cells. A black matrix is formed by filling the groove with a black matrix material. The black matrix is extended parallel to the second and third electrodes 26 and 27. That is, a groove 32 is formed by etching, as shown in FIG. 4, in the front substrate 28 between the second electrode 26 of one discharge cell and the third electrode 27 of the adjacent discharge cell. The groove 32 is filled with light shielding material to form the black matrix 31. The profile of the black matrix 31 can be of various shapes. Preferably, the black matrix 31 is shaped as a revered "V" or a curved dam of which thickness decreases from the bottom to the upper portion.

When the above black matrix 31 is adopted, as shown in FIG. 4, the external light reflected by the second and third electrodes 26 and 27 between the front substrate 28 and the dielectric layer 29 is input to and absorbed by the black matrix 31. Thus, the reflectance of external light is lowered.

Figure 6A:
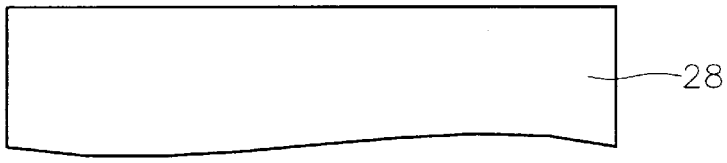
FIGS. 6A through 6C are views showing a process of forming the black matrix of the plasma display according to the present invention.
Figure 6B:
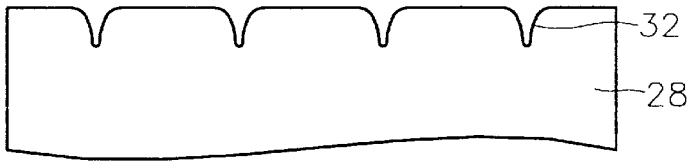
Figure 6C:
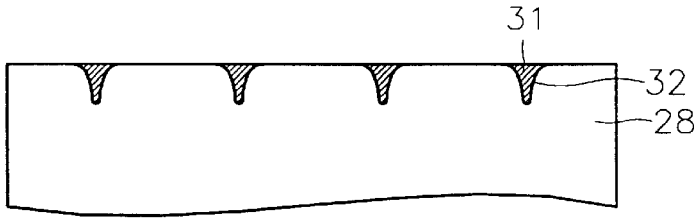
Figure 7:
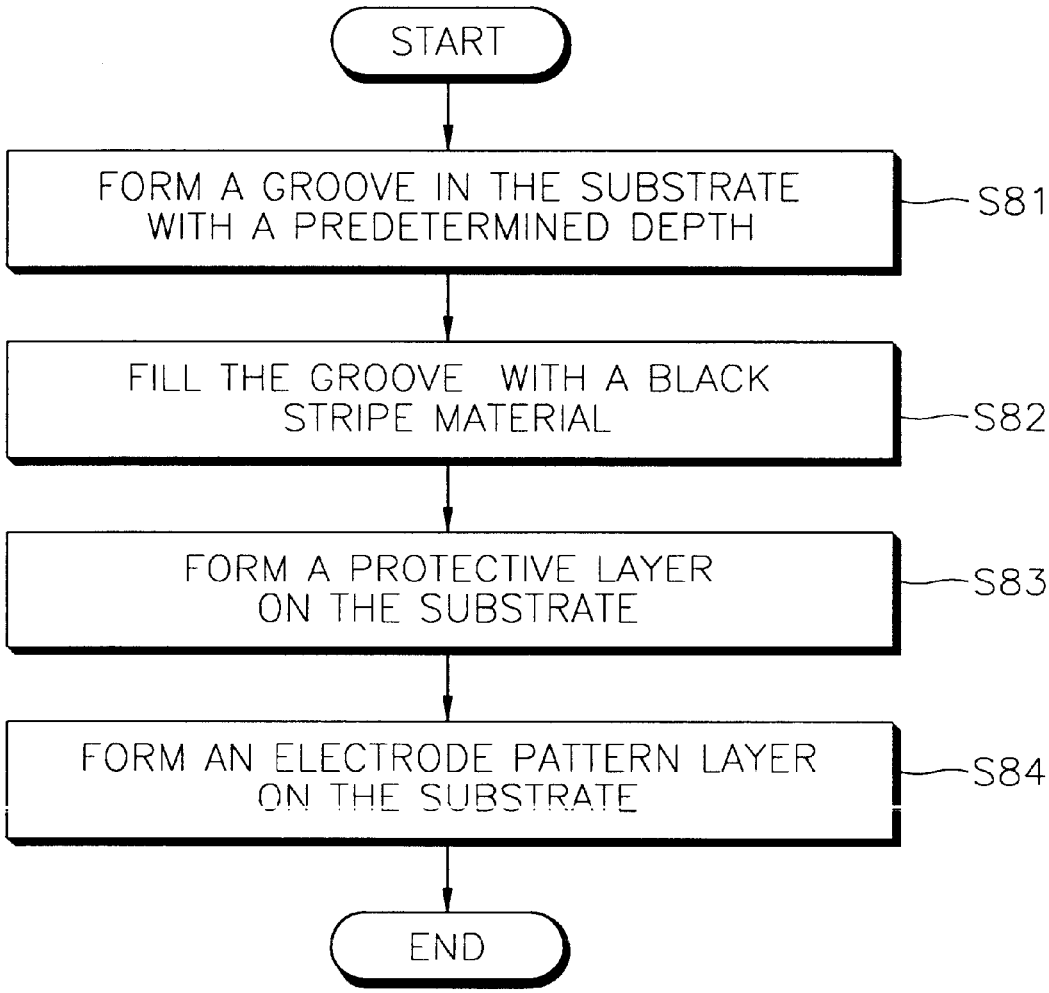
FIG. 7 is a flow chart for explaining a method of manufacturing the plasma display of the present invention.

Referring to FIGS. 6A through 7, methods of forming the black matrix 31 is described as follows. In a method of forming the black matrix 31 according to a first preferred embodiment of the present invention, a mold is used for processing a substrate. When a glass substrate is manufactured, in a state in which the glass substrate is soft before it is cooled in a step of forming a glass plate, a groove is formed using a mold in relief at the surface of the glass substrate, as shown in FIG. 6B (S81 of FIG. 7). Next, black matrix material is coated. For example, inorganic pigment of black color or ND (neutral density) filter material for reducing light amount such as metallic oxide is coated on the entire surface of the glass substrate. The substrate is washed out thereafter so that the inorganic pigment or the ND filter material remains only in the groove, as shown in FIG. 6B (S82 of FIG. 7). Then, a burning process is performed to fuse the black matrix material to adhere to the glass substrate. A protection film such as diffusion prevention film is formed, if necessary (S83 of FIG. 7). When the protection film is completed, an electrode pattern such as a transparent electrode is formed on the substrate.

The second preferred embodiment of the present invention for forming a black matrix uses etching. First, photoresist is coated on a substrate and a predetermined pattern is formed through exposure to light and development. Next, etching is performed at high pressure to remove the photoresist so that the groove 32 as shown in 6B is formed. Such steps as coating inorganic pigment or ND filter material, removing, burning or forming a protection film are performed in the same manner described above. When an etching step of typical pressure is performed, the groove is formed in a U shape, whereas the groove is formed in a nearly V shape when the etching is performed at high pressure through a nozzle. Thus, the etching at high pressure using a nozzle is preferable.

In a third preferred embodiment of the present invention for forming a black matrix, a green tape is used. The green tape is a mixture of glass powder and adhesive in paste form. Such a method will be described with reference to FIGS. 8A and 8B.

Figure 8A:
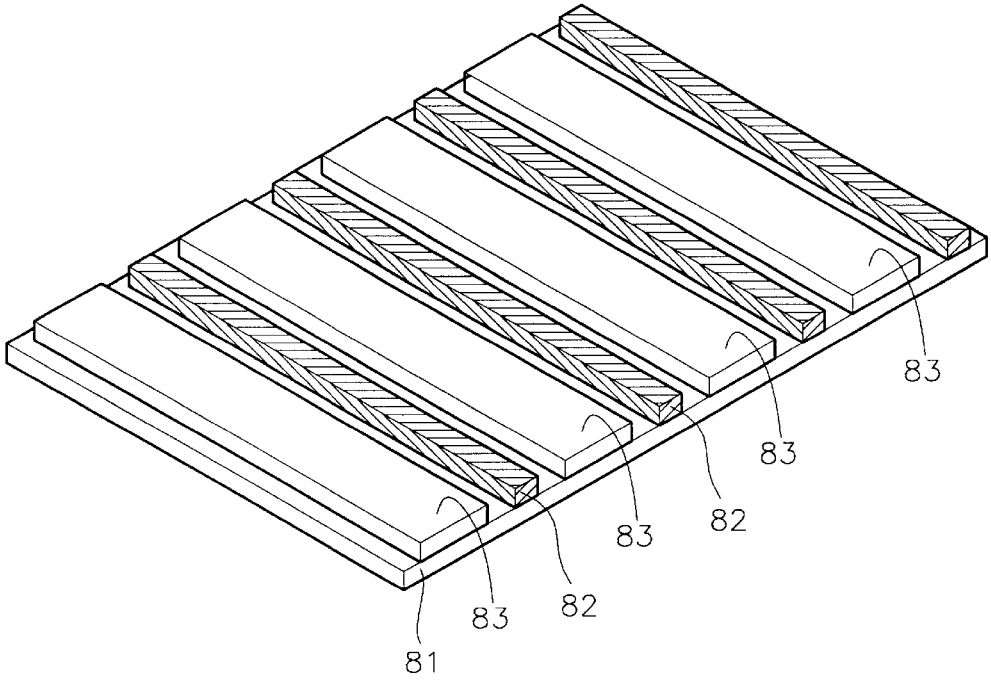
FIGS. 8A and 8B are views showing an alternative process of forming the black matrix of the plasma display according to the present invention.
Figure 8B:
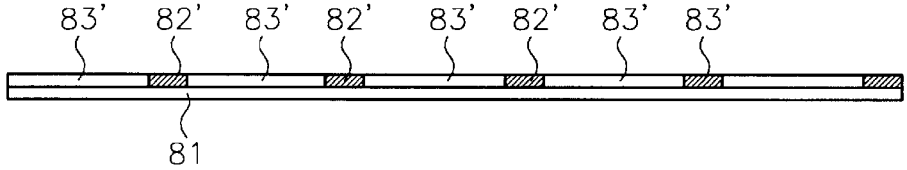

Referring to FIG. 8A, a paste where glass powder and adhesive are mixed is coated on a support body 81 such as a film through a nozzle. Reference numeral 83 denotes paste in a transparent state while reference 82 denotes opaque paste including pigment. A predetermined distance is set between the opaque paste 82 and the transparent paste 83 for providing an extra area so that the above paste can spread out in the subsequent pressing process. Next, a thin and flat green tape as shown in FIG. 8B is formed by pressing the paste from above. Reference numeral 82' denotes the opaque paste including pigment in a pressed state and reference numeral 83' denotes the transparent paste in a pressed state. The pattern of the paste 82' shown in FIG. 8B is congruent with the patten of a black matrix to be formed ultimately. Next, the green tape is attached to a front substrate and, when the support body 81 is detached, a black matrix as one described referring to FIG. 3 is formed on the front glass substrate. The steps as burning and forming a protection film are performed thereafter.

In a fourth preferred embodiment of the present invention for forming a black matrix, the green tape is used in a different manner. First, transparent paste is coated on a film support body to make a green tape and the transparent green tape is laminated on the front glass substrate. Next, the groove 32 as shown in FIG. 6B is formed by pressing the green tape with a mold, or by performing etching using the photoresist pattern described above. Black inorganic pigment or ND filter material is coated on the green tape in a paste state and then removed so that the pigment or ND filter material remains only in the groove 32. The steps such as burning and forming a protection film are performed in the same manner described above. The green tape can be usefully applied as the light transmissivity thereof approaches 96%.

Figure 1:
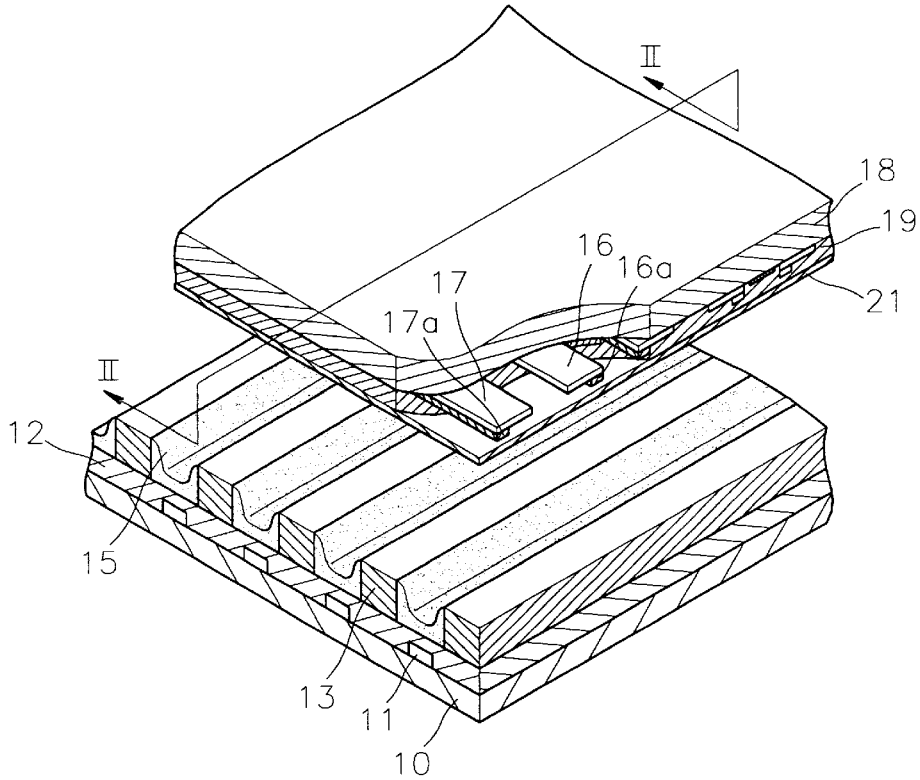
FIG. 1 (PRIOR ART)
FIG. 1 is an exploded perspective view of a conventional plasma display.
Figure 2:
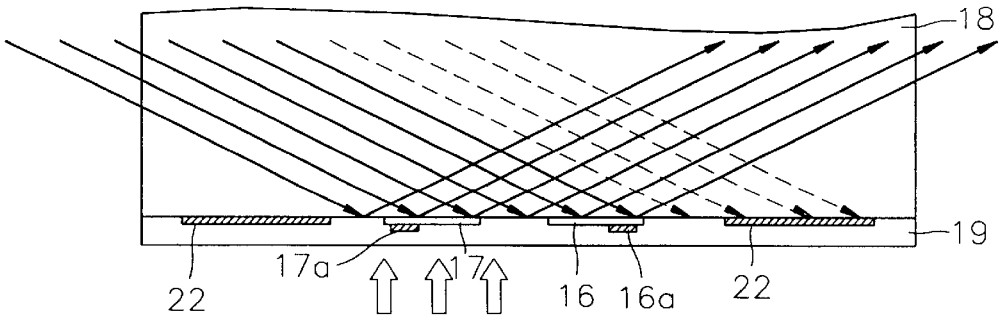
FIG. 2 (PRIOR ART)
FIG. 2 is a sectional view of the plasma display, taken along line II—II of FIG. 1.

Also, in addition to the black matrix 31, it is preferable to form a common flat black matrix layer (32 of FIG. 2).

FIG. 4 shows the structure of the black matrix 31 adopted in the plasma display according to the present invention. Referring to the drawing, the bottom width W of the black matrix 31 is preferably equal to or less than the width of the black matrix (22 of FIG. 2) formed on the conventional front substrate. The height H of the black matrix 31 is set to most effectively reduce the reflection of external light. According to experiments by the present inventor, the height H of the black matrix 31 with respect to distance D between the adjacent black matrixes 31 can be expressed as follows.

$$H \tan \theta \geqq (D/2) \quad (1)$$

Here, θ denotes an incident angle of external light.

Figure 5:
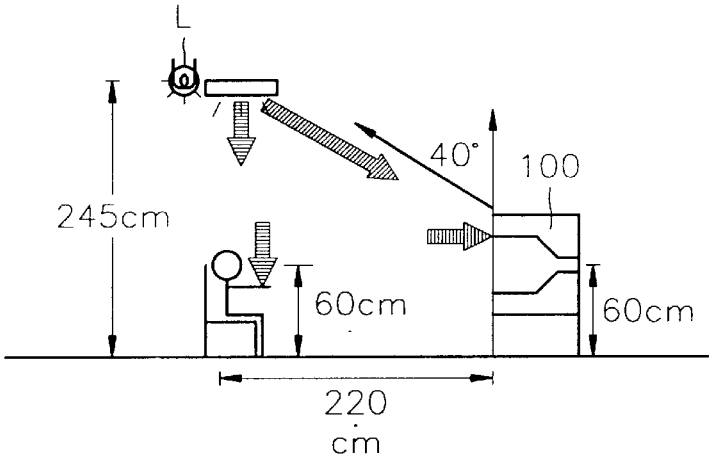
FIG. 5 is a view showing general conditions for watching a plasma display.

FIG. 5 shows general work conditions for using a plasma display. As shown in the drawing, a light source L is installed about 245 cm above the head of a viewer. The eye of the viewer is located at about 60 cm high and a display 100 is placed at about 2.2 m in front thereof. Under the above circumstances, a straight line connecting the light source L and the display 100 makes an angle of about 40° with respect to the horizontal line. In this case, an incident angle θ of the light emitted from the light source L to the surface of the display 100 is about 40°. Thus, the following relationship is obtained from inequality (1).

$$H \tan 40 \geqq (D/2) \quad (2)$$

$$H \geqq 1.19 \times (D/2) \quad (3)$$

Thus, when the bottom width W and the height H of the black matrix 31 are set to meet the above inequalities, the reflectance of external light can be minimum. According to experiments by the present inventor, according to the above relationships, the reflective brightness of the plasma display becomes nearly "0" so that an external light shielding rate can be about 1. Even when the value of H does not satisfy the above relationships, when the H value is greater than the thickness (typically 10 micrometers) of a flat type black matrix film typically used, the external light shielding rate becomes remarkably superior to that of the conventional black matrix. Such a fact can be seen through FIG. 4. For example, the height H of the black matrix is preferably 30 through 60 micrometers and more preferably 50 micrometers.

As described above, according to the present invention, since the external light reflected by the front substrate or electrode can be mostly absorbed by the black matrix provided at the groove formed at the front substrate, the reflectance of external light is lowered and contrast of an image can be improved.

It is noted that the present invention is not limited to the preferred embodiment described above, and it is apparent that variations and modifications by those skilled in the art can be effected within the spirit and scope of the present invention defined in the appended claims.

What is claimed is:

1. A plasma display comprising:

a rear substrate;

a plurality of first electrodes formed in strips and parallel to each other on an inner surface of the rear substrate;

a dielectric layer coated on the rear substrate to cover the first electrode;

a plurality of partitions formed in strips on the dielectric layer, defining a discharge space;

a fluorescent layer coated on an inner surface of the discharge space;

a front substrate which is transparent and coupled above the partitions;

second and third electrodes formed in strips and to be parallel to one another on an inner surface of the front substrate and to cross the first electrodes; and a black matrix formed between a discharge cell constituted by a pair of the second and third electrodes and another discharge cell adjacent thereto, by filling a groove which is formed at the inner surface of the front substrate to be parallel to the second and third electrodes with a light shielding material.

2. The plasma display as claimed in claim 1, wherein the black matrix is formed in a groove which is formed in the front substrate.

3. The plasma display as claimed in claim 2, wherein the profile of the black matrix has a dam shape.

4. The plasma display as claimed in claim 2, wherein the profile of the black matrix has a curved V-shape.

5. The plasma display as claimed in claim 1, wherein the height H of the black matrix, the incident angle θ of external light and the distance D between adjacent black matrices have the following relationship, $$H \tan \theta \geqq (D/2).$$

6. The plasma display as claimed in claim 1, wherein the height H of the black matrix is 30 through 60 micrometers.

7. The plasma display as claimed in claim 1, wherein the height H of the black matrix is 50 micrometers.

* * * * *